US008870351B2

(12) United States Patent
Mardilovich et al.

(10) Patent No.: US 8,870,351 B2
(45) Date of Patent: Oct. 28, 2014

(54) HEATING RESISTOR

(75) Inventors: Peter Mardilovich, Corvallis, OR (US); Lawrence H. White, Corvallis, OR (US); Erik D. Torniainen, Redmond, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 14/118,699

(22) PCT Filed: Jul. 19, 2011

(86) PCT No.: PCT/US2011/044411

§ 371 (c)(1),
(2), (4) Date: Nov. 19, 2013

(87) PCT Pub. No.: WO2013/012417

PCT Pub. Date: Jan. 24, 2013

(65) Prior Publication Data

US 2014/0104344 A1 Apr. 17, 2014

(51) Int. Cl.
*B41J 2/05* (2006.01)
*B41J 2/14* (2006.01)

(52) U.S. Cl.
CPC ..... *B41J 2/14427* (2013.01); *B41J 2/1412* (2013.01)
USPC ..... 347/62; 347/61

(58) Field of Classification Search
CPC ..... B41J 2/1412; B41J 2/1631; B41J 2/1628; B41J 2/1642; B41J 2/1646
See application file for complete search history.

(56) References Cited

U.S. PATENT DOCUMENTS

| | | | |
|---|---|---|---|
| 6,568,792 | B2 | 5/2003 | Andrews et al. |
| 6,877,842 | B2 | 4/2005 | Moon et al. |
| 7,057,138 | B2 | 6/2006 | Lopez et al. |
| 7,287,836 | B2 | 10/2007 | Silverbrook |
| 7,628,471 | B2 | 12/2009 | Silverbrook |
| 2002/0008734 | A1 | 1/2002 | Lee et al. |
| 2002/0149649 | A1 | 10/2002 | Moon et al. |
| 2008/0078756 | A1 | 4/2008 | Russegger et al. |
| 2009/0141090 | A1 | 6/2009 | Silverbrook |

FOREIGN PATENT DOCUMENTS

| | | | |
|---|---|---|---|
| KR | 20020089650 | | 11/2002 |
| SU | 1731690 | A1 * | 5/1992 |

* cited by examiner

*Primary Examiner* — Lisa M Solomon

(57) ABSTRACT

A heating element of a fluid ejection device, the heating element including a ring-type body, an inner edge of the body, and an outer edge of the body, wherein at least one of the inner edge and the outer edge defines an undulated surface contour.

15 Claims, 3 Drawing Sheets

HEATING RESISTOR

BACKGROUND

One type of fluid ejection device is a thermal inkjet printing device. A thermal inkjet printing device forms images on media like paper by thermally ejecting drops of fluid onto the media in correspondence with the images to be formed on the media. The drops of fluid are thermally ejected from the thermal inkjet printing device using a heating resistor. When electrical power is applied to the heating resistor, the resistance of the heating resistor causes the resistor to increase in temperature. This increase in temperature causes a bubble to be formed. The bubble, in turn, pushes fluid through a small orifice, thereby ejecting a fluid drop.

DETAILED DESCRIPTION

As noted above, a thermal inkjet printing device is a fluid ejection device that ejects drops of fluid onto media by applying electrical power to a heating resistor. The temperature of the heating resistor thus increases, causing formation of a bubble, which ultimately results in the drops of ink being ejected. Traditionally, the heating resistor has been in the shape of a solid rectangle.

Other shapes of heating resistors may improve the efficiency of the heating resistor and of the thermal fluid-ejection device itself. However, deviating from the basic solid rectangular shape may be disadvantageous, even in light of the resulting improved efficiency. For example, electrical current will follow the path of least resistance, possibly leading to uneven heating, and thus long-term reliability issues.

Disclosed herein is a heating element that avoids uneven heating, while still improving efficiency as compared to a simple rectangular heating resistor. The disclosed heating element manages the temperature gradient at least in part by maintaining a high length-to-width ratio of the resistor. In some examples, the heating element takes the form of a ring-type heating resistor with a resistor body having an edge with plural peaks. More particularly, the resistor may take the form of a circular ring-type heating resistor defining inner and outer edges, at least one of which is undulated.

Figure 1:
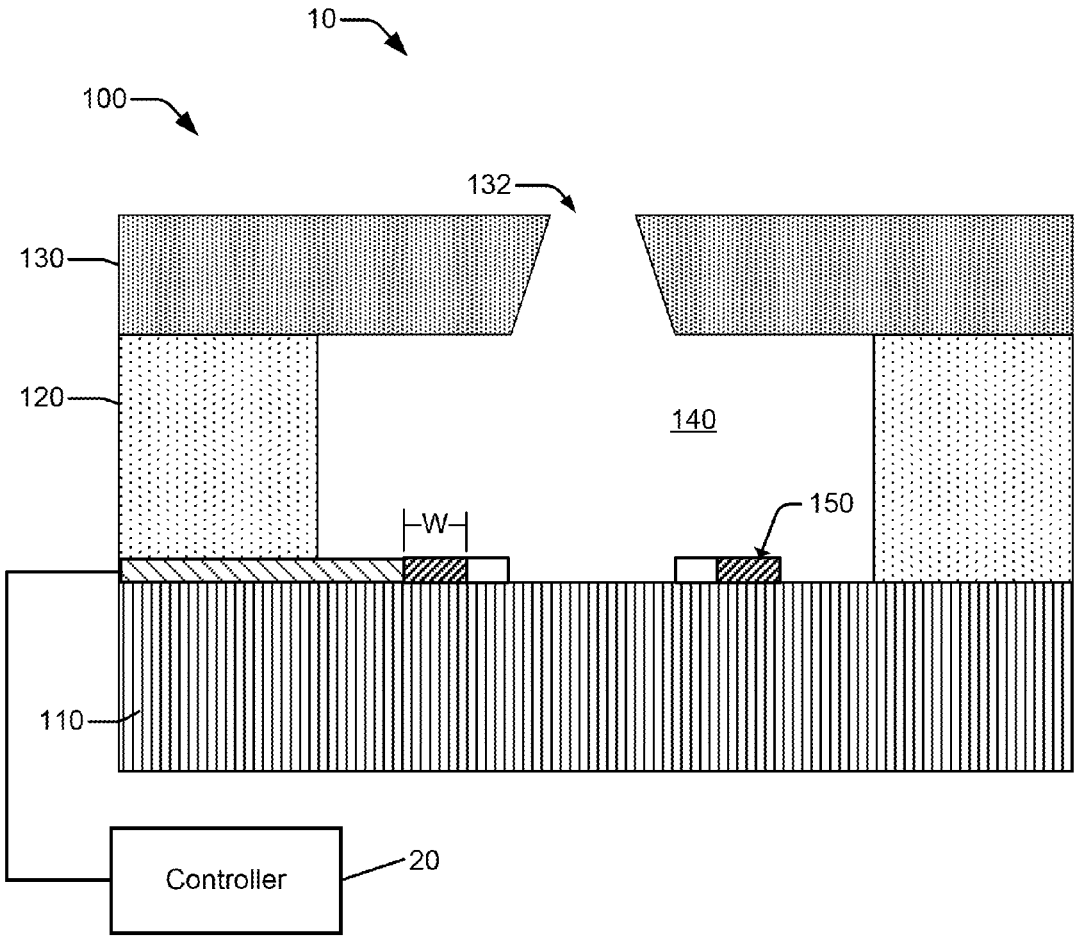
FIG. 1 depicts a fluid ejection device including a thermal fluid ejection mechanism shown in cross sectional side view as including a ring-type heating resistor according to an embodiment of the invention.

FIG. 1 is a cross-sectional side view of a fluid ejection device 10 including an example thermal fluid ejection mechanism 100. The thermal fluid ejection mechanism 100 may form a part of an inkjet printhead, which may include a number of such mechanisms.

Fluid ejection device 10 may be an inkjet printing device that ejects ink onto media, such as paper, to form images on the media. The fluid ejection device is more generally a precision dispensing device that precisely dispenses fluid, such as ink, melted wax, polymers, or any number of other fluids. Fluid ejection device 10 may eject pigment-based ink, dye-based ink, another type of ink, or another type of fluid. Fluid ejection device 10 thus may be any type of precision dispensing device that dispenses a substantially liquid fluid.

Fluid ejection device 10 therefore may be a drop-on-demand device in which printing, or dispensing, of the substantially liquid fluid in question is achieved by precisely printing or dispensing in accurately specified locations, with or without making a particular image on that which is being printed or dispensed on. Fluid ejection device 10 thus may be any device that precisely prints or dispenses a substantially liquid fluid in that the latter is not substantially or primarily composed of gases such as air. Examples of such substantially liquid fluids include inks, in the case of thermal inkjet printing devices. Other examples of substantially liquid fluids include drugs, cellular products, organisms, and so on, which are not substantially or primarily composed of gases such as air and other types of gases.

The thermal fluid ejection mechanisms described herein may be implemented using a controller 20. The controller 20 may be implemented in hardware, or a combination of machine-readable instructions and hardware, and controls ejection of drops of fluid from the thermal fluid ejection mechanisms. One or more of such thermal fluid ejection mechanisms may define an inkjet printhead.

As indicated, the example thermal fluid ejection mechanism 100 includes a substrate 110, a barrier layer 120 on the substrate, and a nozzle layer 130 on the barrier layer and defining one or more orifices 132. The substrate 110, barrier layer 120 and nozzle layer 130 together define a fluid chamber 140. A heating element 150, in turn, may be disposed on, in or above the substrate, in the fluid chamber 140.

In operation, fluid enters fluid chamber 140 through an inlet (not shown) defined in the substrate and/or barrier layer, and is stored in the fluid chamber for subsequent ejection. Upon energizing heating element 150 with an electrical current pulse, fluid in the fluid chamber is heated, causing an expanding vapor bubble to eject fluid from the nozzle 132. When the current pulse ends, heating element 150 cools. The vapor bubble thus collapses and draws more fluid from a reservoir (not shown) into the fluid chamber in preparation for the next ejection. This ejection process may be repeated thousands of times per second during printing.

Heating element 150 may take the form of a ring-type resistor that defines a current path around (rather than through) a central region of fluid chamber 140. Heating element 150 may be made of tungsten silicon nitride (WSiN), a tantalum aluminum alloy, or any other suitable resistive material capable of generating heat upon energization. Although not particularly shown, heating element 150 may have an overcoat layer, including, for example, a dielectric coating to prevent corrosion (e.g., electrical, chemical and/or mechanical). In addition, the overcoat layer may include a protective coating such as tantalum (Ta) over the dielectric coating, typically as protection for the resistor surface against forces generated during bubble collapse.

Figure 2:
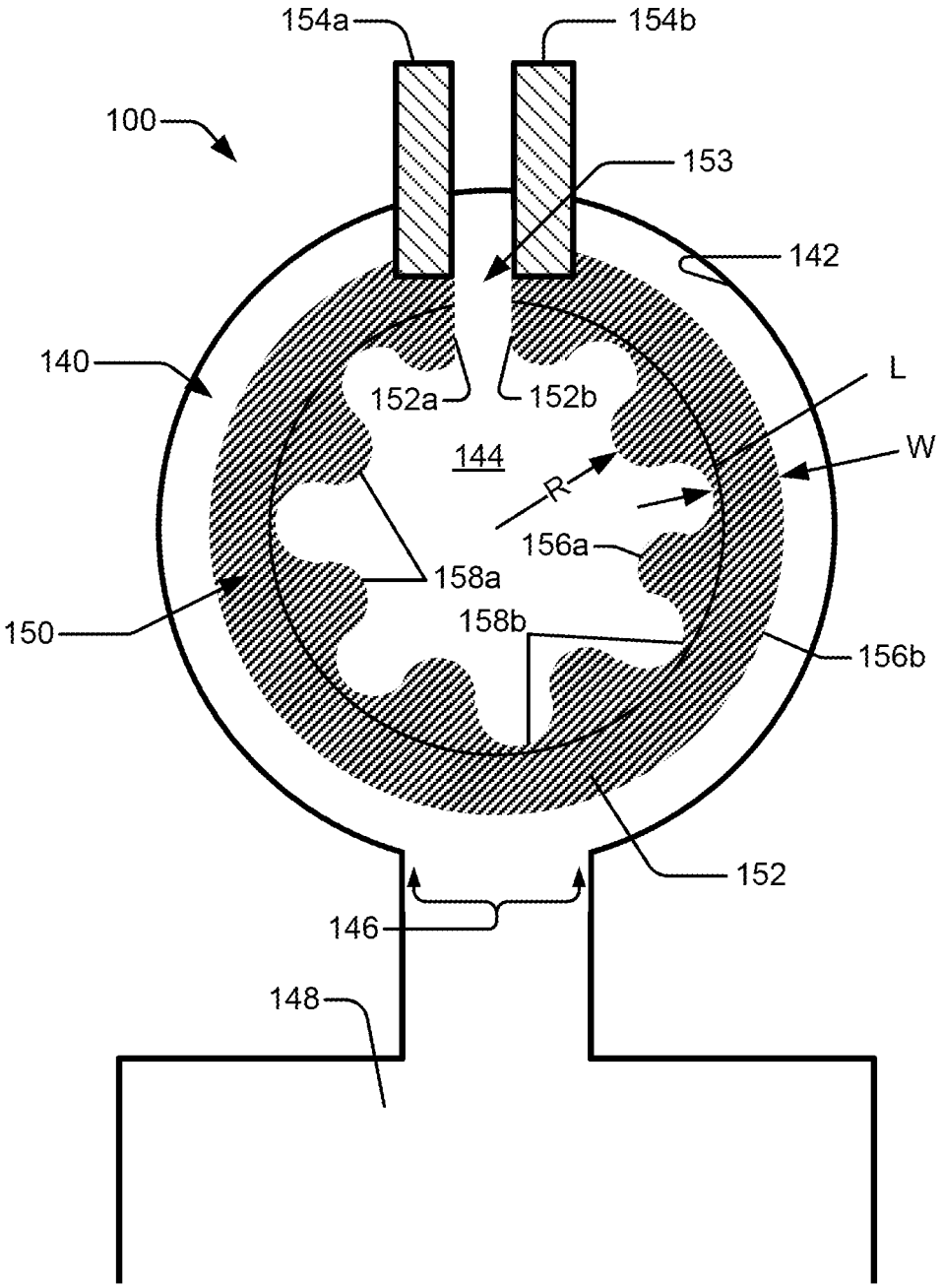
FIG. 2 is a top view diagram of the thermal fluid ejection mechanism of FIG. 1, including an example ring-type heating resistor according to an embodiment of the invention.

Referring now to FIG. 2, a partial top-down view of a thermal fluid ejection mechanism 100 is shown, but with the nozzle layer removed to more clearly illustrate the interior of fluid chamber 140. In the present example, fluid chamber 140 is defined at least in part by a generally cylindrical upright sidewall 142, and a generally planar horizontal floor 144.

Although the fluid chamber 140 may be illustrated and discussed herein with respect to a particular shape and size, the shape and size of the fluid chamber are not limited in this respect. Rather various shapes and sizes of the fluid chamber are contemplated. For example, the fluid chamber may be circular, rectangular, or some other shape, and may include one or more upright sidewalls. Furthermore, it is to be understood that the size of the fluid chamber 140, shown in relation to the ejection mechanism 100, is for purposes of illustration only and is not intended to be a scaled representation.

A fluid inlet 146 provides fluid access to the fluid chamber, fluid generally being provided via an ink channel 148. The fluid inlet and ink channel may take various forms, only one of which is illustrated in FIG. 2.

As noted above, heating element 150 may take the form of a generally circular ring-type resistor. Heating element 150 thus may include a generally planar ring-type resistor body 152, which may be formed on, in or above the fluid chamber floor 144. Ring-type resistor body 152 may be generally symmetrical about an axis perpendicular to FIG. 2, intersecting a center point of the fluid chamber floor 144. As indicated, resistor body 152 may define a gap 153 such that the resistor body has opposite ends 152*a*, 152*b*. Conductive leads 154*a*, 154*b* may be electrically connected to the opposite ends 152*a*, 152*b* of resistor body 152. The conductive leads 154*a*, 154*b* may be formed from aluminum, copper, gold, silver, platinum, a combination thereof, or another type of conductive material.

The resistor body 152 is resistive in that the resistor has greater resistance than that of the conductors such as conductive leads 154*a*, 154*b*. Likewise, the conductive leads 154*a*, 154*b* are conductive in that they are considered conductors that have greater conductance than that of the resistor body 152. The resistance of the resistor body 152 is many times greater than the resistance of the conductive leads 154*a*, 154*b* (as one example, this resistance ratio may be 5000 or higher).

The conductive leads 154*a*, 154*b* selectively provide power to fire the resistor. For example, an electrical current pulse may pass through conductive lead 154*a*, through the resistor body 152, and then through conductive lead 154*b*. The current pulse will take the path of least resistance, which typically is the shortest path through resistor body 152.

As indicated, heating element 150 includes an inner edge 156*a* facing the central region of fluid chamber 140, and an outer edge 156*b* facing fluid chamber sidewall 142. In the present example, outer edge 156*b* is spaced from fluid chamber sidewall 142, but such spacing is not necessary to operation of heating element 150 as described herein.

In some examples, inner edge 156*a* is radially contoured to define plural inward-facing peaks 158*a*. Although not particularly shown in the present example, outer edge 156*b* similarly may be radially contoured.

In the present example, inner edge 156*a* defines an undulated edge contour that extends along substantially the entire span of the inner edge 156*a*. The distance R from the center of the fluid chamber to the inner edge 156*a* of resister body 152 thus varies along the entire span of the inner edge 156*a*. In some examples, inner edge 156*a* is a defined by a smooth wavy line, establishing alternating inward-facing peaks 158*a* and valleys 158*b*. The distance between inner edge 156*a* and outer edge 156*b* thus may be seen to increase and decrease along a circular path of the resistor body.

As indicated in FIG. 2, peaks 158*a* may be disposed at opposite ends 152*a*, 152*b* of resistor body 152. The distance between inner edge 156*a* and outer edge 156*b* thus tends to be greater at or near the opposite ends of resistor 152 body than at some positions along the circular path of resistor body 152. This tends to minimize the occurrence of "hot spots" at such opposite ends, which might otherwise lead to resistor damage and/or resistor failure.

Width W of the resistor may be defined as the minimal distance between inner edge 156*a* and outer edge 156*b*. As will be explained further, such width at least in part determines a temperature gradient of the resistor upon passage of current through the resistor.

Length L of the resistor may be defined as the minimal circumferential path that may be drawn entirely within the resistor. As noted above, the current path will be the path of least resistance, which typically is the shortest path through resistor 152 body. Accordingly, the current path generally can be controlled by selecting an appropriate contour of the inner edge 156*a* and/or outer edge 156*b*. In FIG. 2, the length L corresponds generally to a substantially circular path along the bottoms of valleys 158*b*. This substantially circular path is the shortest path through resistor body 152, and thus may correspond to the current path through the resistor body In some examples, the edge contour may be defined to provide the resistor with a relatively high effective length-to-width ratio, generally on the order of 15-to-1 or more. A relatively high effective length-to-width ratio helps to minimize resistor "hot spots", which could otherwise lead to resistor damage and/or resistor failure.

Figure 3:
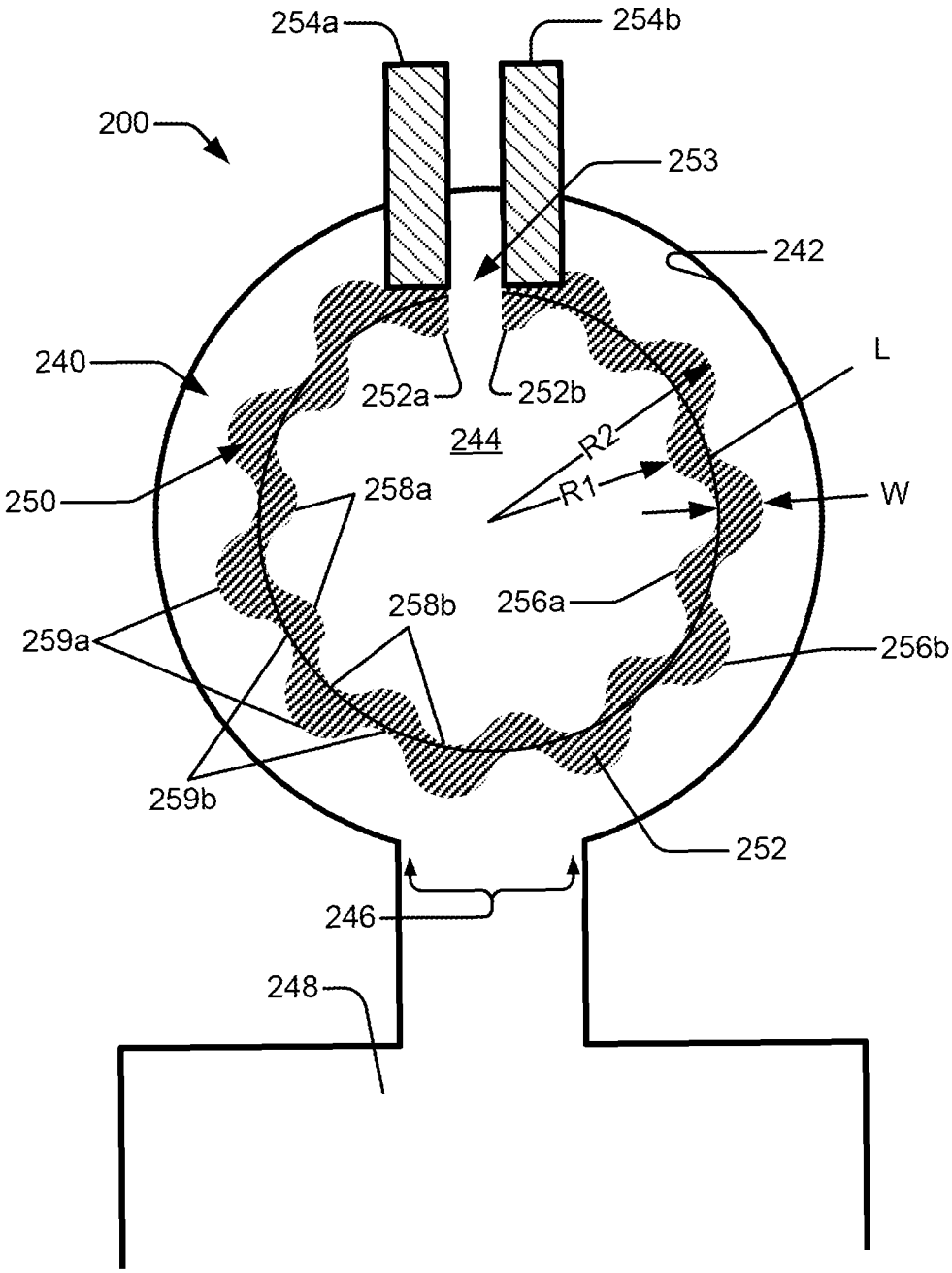
FIG. 3 is a top view diagram of the thermal fluid-ejection mechanism, including an example ring-type heating resistor according to another embodiment of the invention.

FIG. 3 is a partial top-down view of another thermal fluid ejection mechanism 200 (with the nozzle layer removed to more clearly illustrate the interior of fluid chamber 240. As indicated, fluid chamber 240 is generally cylindrical, and is defined at least in part by a generally circular upright sidewall 242, and a generally horizontal floor 244. A fluid inlet 246 provides fluid access to the fluid chamber, fluid generally being provided via an ink channel 248. It is again to be understood that the size and shape of the fluid chamber 240 is for purposes of illustration only and is not intended to be limiting.

In FIG. 3, the thermal fluid ejection mechanism 200 includes a heating element 250 in the form of a generally circular ring-type resistor. The heating element 150 thus may include a generally planar ring-type resistor body 252. Resister body 252 may be formed on, in or above the fluid chamber floor 244, and may define a gap 253 such that resistor defines opposite ends 252*a*, 252*b*. Conductive leads 254*a*, 254*b* may be electrically connected to the opposite ends 252*a*, 252*b* of resistor 252.

Upon application of electrical current pulse, current may pass through conductive lead 254*a*, through the resistor body 252, and then through conductive lead 254*b*. The current path through the resistor body will be the path of least resistance, which generally will be the path of least resistance between conductive leads 254*a*, 254*b*. As will now be described, resistor body 252 may be contoured to ensure that the shortest path through resistor is (on average) through a radial center of the resistor body. In other words, the shortest path through resistor body 252 includes substantially equal amounts of resister material interior and exterior the resistor path (corresponding to length L).

Resistor body 252 defines an inner edge 256*a* facing the center of fluid chamber 240, and an outer edge 256*b* facing fluid chamber sidewall 242. In FIG. 3, both inner edge 256*a* and outer edge 256*b* have undulated edge contours. Accordingly, both the distance R1 from the center of the fluid chamber to the inner edge 256*a* and the distance R2 from the center of the fluid chamber to the outer edge 256*b* may vary along the circular path of the resistor. As indicated, inner edge 256*a* and outer edge 256*b* may vary in concert so as to define a resistor having an undulated circular path. In some examples, the width W (the distance between inner and out edges of the resistor) may be relatively constant along the undulated circular path of the resistor.

Referring still to FIG. 3, inner edge 256*a* will be seen to define alternating inward-facing peaks 258*a* and valleys

258*b*. Similarly, outer edge 256*b* will be seen to define alternating outward-facing peaks 259*a* and valleys 259*b*. As shown, inward-facing peaks 258*a* may correspond in a radial direction to outward-facing valleys 259*b* and inward-facing valleys 258*b* may correspond in a radial direction to outward-facing peaks 259*a*. In this manner, the width W of the resistor body 252 may be relatively constant along the undulated circular path of the resistor body.

In some examples, the alternating inward-facing peaks and valleys may define an inward-facing sinusoidal contour. The alternating outward-facing peaks and valleys similarly may define an outward-facing sinusoidal contour. Such sinusoidal contours may align to provide resistor body having a width W that is constant along the path of the resistor body 252. For example, inward-facing peaks 258*a* may align in a radial direction with outward-facing valleys 259*b*, and inward-facing valleys 258*b* may align in a radial direction with outward-facing peaks 259*a*.

As noted above, length L of the resistor may be defined as the minimal circumferential path that may be drawn entirely within the resistor. The current path will be the path of least resistance (typically, the shortest path through resistor body 252). In FIG. 3, the current path generally corresponds to a circular path (corresponding to length L) along the bottoms of both inward-facing valleys 258*b* and outward-facing valleys 259*b*. The current path thus may be seen to tangentially intersect both inward-facing valleys 258*b* and outward-facing valleys 259*b*. The resistor heat gradient can be controlled by selecting an appropriate contour of the inner and outer edges of the resistor body 252.

When electrical current is applied to the ring-type heating resistor 250, heating of the resistor is generally uniform along the length L of the resistor body. This is because electrical current flows through the resistor body substantially uniformly. For instance, because the inner and outer edges are complementary, the nominal current path is effectively defined through the center of the resistor body. Correspondingly, heat is distributed evenly both interior the nominal current path and exterior the nominal current path.

Where the resistor edges are defined by wavy lines, as shown in FIG. 3, the period and amplitude of the internal and/or external edge may be defined to accommodate a desired resistor width W. Such width may be selected to achieve a desired temperature gradient across the width of the resistor and/or to achieve a desired characteristic of an ejected fluid drop.

We claim:

1. A heating element of a fluid ejection device, the heating element comprising:

a ring-type resistor body that is connectable between electrically conductive leads to define between the leads an electrically conductive path that generates heat upon application of an electrical current pulse via the conductive leads;

an inner edge of the body; and an outer edge of the body;

wherein at least one of the inner edge and the outer edge defines an undulated edge contour.

2. The heating element of claim 1, wherein the inner edge is radially contoured to define a plurality of inward-facing peaks and valleys.

3. The heating element of claim 2, wherein the outer edge is radially contoured to define a plurality of outward-facing peaks and valleys.

4. The heating element of claim 1, wherein the inner edge and outer edge each define peaks and valleys, peaks of the inner edge corresponding in a radial direction to valleys of the outer edge, and valleys of the inner edge corresponding in a radial direction to peaks of the outer edge.

5. The heating element of claim 4, wherein the valleys of the inner edge and the valleys of the outer edge define a current path through the resistor body.

6. The heating element of claim 5, wherein the current path is substantially circular.

7. The heating element of claim 1, wherein the undulated surface contour extends along substantially an entire span of at least one of the inner edge and the outer edge.

8. The heating element of claim 1, wherein the undulated surface contour defines a smooth wave contour.

9. The heating element of claim 1, wherein the ring-type body has a length-to width ratio of at least 15-to-1.

10. An fluid ejection mechanism comprising:

a substrate;

a barrier layer on the substrate;

a nozzle layer on the barrier layer, the substrate, the barrier layer and the nozzle layer together forming a fluid chamber with a chamber floor; and a ring-type resistor having a resistor body on the chamber floor, the resistor body defining an inner edge with plural inward-facing peaks.

11. The fluid ejection mechanism of claim 10, wherein the resistor body further defines an outer edge with plural outward-facing peaks.

12. The fluid ejection mechanism of claim 11, wherein the resistor body defines alternating inward-facing peaks and valleys and alternating outward-facing peaks and valleys, inward-facing peaks aligning in a radial direction with outward-facing valleys, and inward-facing valleys aligning in a radial direction with outward-facing peaks.

13. The fluid ejection mechanism of claim 12, wherein the alternating inward-facing peaks and valleys define an inward-facing sinusoidal contour and the alternating outward-facing peaks and valleys define an outward-facing sinusoidal contour.

14. The fluid ejection mechanism of claim 13, wherein the resistor body defines a current path tangentially intersecting the inward-facing valleys and outward-facing valleys.

15. An inkjet printhead including a fluid ejection mechanism with a heater resistor contained within a fluid chamber, the heater resistor comprising:

a planar ring-type resistor body;

an inner edge having a first sinusoidal edge contour; and an outer edge having a second sinusoidal edge contour, the inner edge and outer edge being complementary to maintain a consistent resistor width along a current path through the resistor.

* * * * *